US005829486A

United States Patent [19]

Sahuc

[11] Patent Number: 5,829,486

[45] Date of Patent: Nov. 3, 1998

[54] FRAME AND METHOD FOR PRODUCING FRINGES WITH BRAIDED HEADS

[75] Inventor: Antoine Sahuc, Quartier de l'Hôpital, France

[73] Assignee: Michel Sahuc, Jonzieux, France

[21] Appl. No.: 867,529

[22] Filed: Jun. 2, 1997

[30] Foreign Application Priority Data

May 31, 1996 [FR] France ..... 96 06962

[51] Int. Cl.[6] ..... D03D 5/00; D03D 47/04; D03D 47/40

[52] U.S. Cl. ..... 139/11; 139/118; 87/7; 87/30; 87/32

[58] Field of Search ..... 139/11, 118, 395; 8/7, 30, 32, 28

[56] References Cited

U.S. PATENT DOCUMENTS

| | | | |
|---|---|---|---|
| 1,044,226 | 11/1912 | Muller | 139/118 |
| 1,530,600 | 3/1925 | Jenny et al. . | |
| 1,746,790 | 2/1930 | Newman . | |
| 3,152,620 | 10/1964 | Libby . | |
| 3,186,442 | 6/1965 | Gale | 139/118 |
| 3,301,204 | 1/1967 | Chambers . | |
| 3,391,595 | 7/1968 | Iwai | 87/7 |
| 3,867,967 | 2/1975 | Rocchia et al. | 139/11 |
| 4,881,444 | 11/1989 | Krauland | 87/8 |

FOREIGN PATENT DOCUMENTS

| | | | |
|---|---|---|---|
| 2078 795 | 1/1982 | United Kingdom | 139/11 |

*Primary Examiner*—Andy Falik
*Attorney, Agent, or Firm*—Oliff & Berridge, PLC

[57] ABSTRACT

A frame comprises, perpendicular to a longitudinal framework, a support with a spool of core strand, a rotating wheel with bobbins of twisted strand, and structure for forwarding the bundles of strands parallel to the longitudinal direction of movement of two spreads of warp thread. The frame accommodates a hook that moves back and forth and grabs one of the twisted strands wound around the core strand, introduces it between the two warp spreads to produce a fringe, and then grabs another strand. A fringing hook is mounted on the end of a rod that can be disengaged from the driving device and has at the end opposite the hook a shank that can come to rest during conclusion of the fringe-producing stroke against at least one surface of one of the stops in a mechanism that can be sequentially moved to vary the stroke of the hook in accordance with the pattern selected for the fringes.

9 Claims, 3 Drawing Sheets

FRAME AND METHOD FOR PRODUCING FRINGES WITH BRAIDED HEADS

BACKGROUND OF THE INVENTION

The present invention relates to a frame and method for producing fringes with braided heads. In fringes of this type, each twisted strand that constitutes a fringe also surrounds a selvage core that is perpendicular to the fringe, and the fringes are connected by two spreads of interlacing warp threads. This type of braided-head fringe differs from those produced on a loom, wherein the heads of the fringes are connected on both sides by two spreads of warp threads that constitute a selvage with no longitudinal core and are accordingly visible.

Braided-head fringes are produced on special frames that comprise, perpendicular to a longitudinal framework, a support with a spool of core strand, a rotating wheel with bobbins of twisted strand for the fringes, and structure forwarding the bundles of strands parallel to the longitudinal direction of movement of two spreads of warp thread. Such frames accommodate a hook that moves back and forth and grabs one of the twisted strands revolving around the core strand, introduces it between the two spreads to produce a fringe, and then grabs another strand.

However, such frames can only be employed automatically to produce fringes of equal length. Fringes of varying length can only be produced by drawing them out manually one at a time to an extent depending on the desired pattern of the fringes. Such manual intervention considerably slows down the procedure and makes the fringes more expensive to produce. Undulating fringes are accordingly very limited in application.

SUMMARY OF THE INVENTION

One object of the present invention is to eliminate these drawbacks and to provide a frame that can be employed to automatically produce undulating fringes with braided heads.

According to one aspect of the invention, there is provided a frame system including a fringing hook mounted on the end of a rod that can be driven by a translation driving device. The hook is associated with a shank that can rest during conclusion of the fringe-producing process against at least one surface of at least one stop in a mechanism that can be sequentially moved to vary toe path traveled by the hook in accordance with an undulation pattern designated by the fringes. In this system, the length of each fringe may be a function on the contact between the shank associated with the hook and the surface of the stop. The length can be varied in accordance with the varying longitudinal position of the surface against which the shank comes to rest.

In one embodiment of the present invention, the hook may be located at the end of the forward piston rod of a dual-action pneumatic piston-and-cylinder mechanism with two piston rods, and the shank is located on the rear piston rod. Driving in this embodiment may be pneumatic.

Additional characteristics and advantages will be evident from the following specification, wherein preferred embodiments of the present invention will be specified by way of examples with reference to the accompanying schematic drawings but without limiting the scope of the invention in any way.

BRIEF DESCRIPTION OF THE DRAWINGS

Preferred embodiments of the invention will be described with reference to the following illustrative drawings, in which.

DETAILED DESCRIPTION OF PREFERRED EMBODIMENTS

Figure 1:
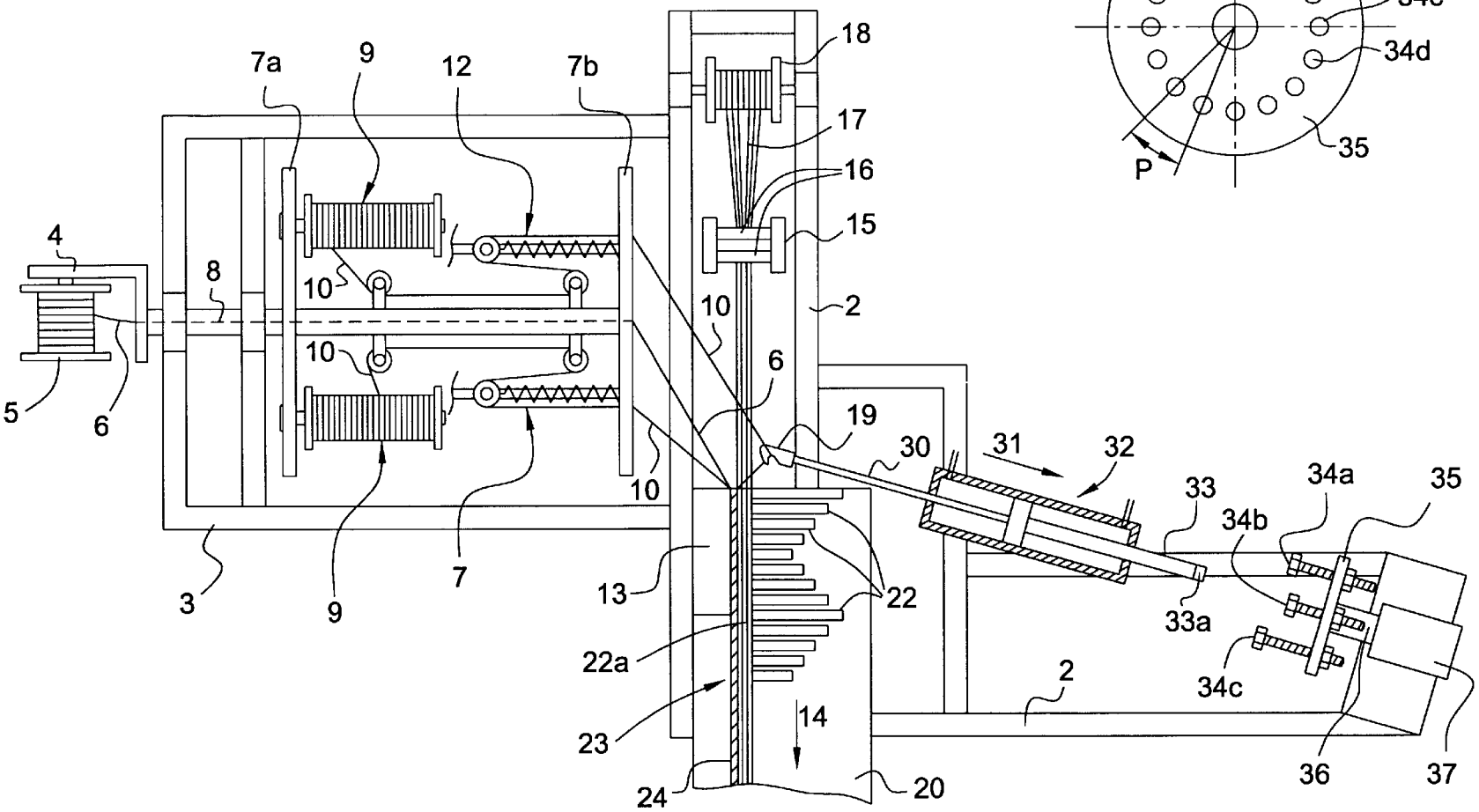
FIG. 1 is a schematic overhead view of a fringe-producing frame that includes one embodiment of an adjustable fringe-pulling device.

The frame for producing braided-head fringes illustrated in FIG. 1 includes a framework 2 with a box 3 secured to the side. Mounted on box 3 is a bracket 4. Rotating in bracket 4 is a spool 5 of twisted strand 6 that constitutes the core of the braided head. Box 3 accommodates a wheel 7 that rotates around a hollow shaft 8. Shaft 8 is traversed by twisted strand 6, which forms the core. The rotation of wheel 7 is synchronized with the operation of the frame. The wheel 7 is provided with flanges 7*a* and 7*b* as well as with several bobbins 9 of twisted strand 10. The unwinding of each twisted strand 10 is regulated by a mechanism 12. Each twisted strand 10 travels through the downstream flange 7*b* on wheel 7 and is combined with the other twisted strands 10 and with core strand 6 by a mechanism 13 that forwards the strands along a direction 14 traveled by the work in the frame and indicated by the arrow in FIG. 1.

Mounted on framework 2 is structure 15 for raising and lowering at least two warp holders 16 that position two spreads of warp thread 17 from bobbins 18. A hook 19 travels back and forth in a straight line and grabs each twisted strand 10 in succession, producing fringes 22 on work 23 on operating surface 20. As long as hook 19 remains outside the two spreads of warp thread 17, warp holders 16 are moved, ensuring attachment of heads 22*a* of fringes 22 due to the interlacing of warp threads 17. This attachment occurs substantially level with a braided head 24 comprising the core strand 6 around which twisted strands 10 are wound while they are not producing fringes 22.

Figure 2:
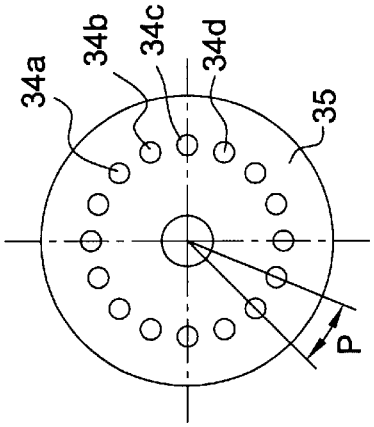
FIG. 2 is a lateral view of the mechanism whereon are mounted the stops illustrated in FIG. 1.

In the particular embodiment illustrated in FIG. 1, hook 19 is positioned at the end of a forward piston rod 30 of a dual-action pneumatic piston-and-cylinder mechanism 32 with two piston rods, the rear piston rod 33 of which is provided with a shank 33*a*. Shank 33*a* operates in conjunction with the surfaces of stops 34*a*, 34*b*, 34*c*, 34*d* etc. Each stop, for example, is mounted on and aligned by a mechanism that comprises in the embodiment illustrated in FIG. 1, for example, a disk 35 that is rotatable around an axis parallel to the direction in which the hook and the piston rods are moved. Disk 35 is mounted tightly around a shaft 36 that is rotated by a stepped motor 37. Motor 37 and piston-and-cylinder mechanism 32 are mounted on framework 2. Stops 34*a*, 34*b*, 34*c*, 34*d* etc. project out of the surface of disk 35 facing shank 33*a* and are equally distributed around a circle at a constant angular pitch P as illustrated in FIG. 2. The stops project out to different extents. The stops comprise, for example, screws that screw into threaded bores in disk 35 such that their heads can come into contact with shank 33*a*.

In operation, piston-and-cylinder mechanism 32 is charged and moved in the direction indicated by the arrow 31 in FIG. 1. The hook 19 at the end of forward piston rod 30 captures or grips a twisted strand 10. The stroke of the piston and rods 30 and 33 and accordingly that of hook 19 and the length of the fringe currently being produced will be controlled by the distance between shank 33*a* and the particular stop 34*a*, 34*b*, 34*c*, 34*d* etc. that faces it. It will accordingly be evident that all that is necessary to vary the length of the fringes and obtain the desired undulation therein is for motor 37 to rotate disk 35, aligning a stop of the requisite height with shank 33*a*.

It should be noted that, when shank 33*a* comes into contact with the stop before the piston has completed its stroke, the operation of piston-and-cylinder mechanism 32 will not be affected because the mechanism will either be responding to its internal pressure or its pneumatics will be provided with an automatic release valve, meaning that it will disengage or stop driving. Charging piston-and-cylinder mechanism 32 in the opposite direction will automatically advance the piston to its forward limit and accordingly ensure the position of hook 19 within the spread of twisted strands 10 and in particular the interception of the forward-most twisted strand.

To vary the pattern of the undulations followed by the free ends of fringes 22, it will be necessary only to vary the height of the stops and, in that event, the angle of rotation of disk 35, for example, by pivoting the disk 35 by one or more increments. This simple device allows uninterrupted and entirely automatic production of braided-head fringes of varying length.

Figure 3:
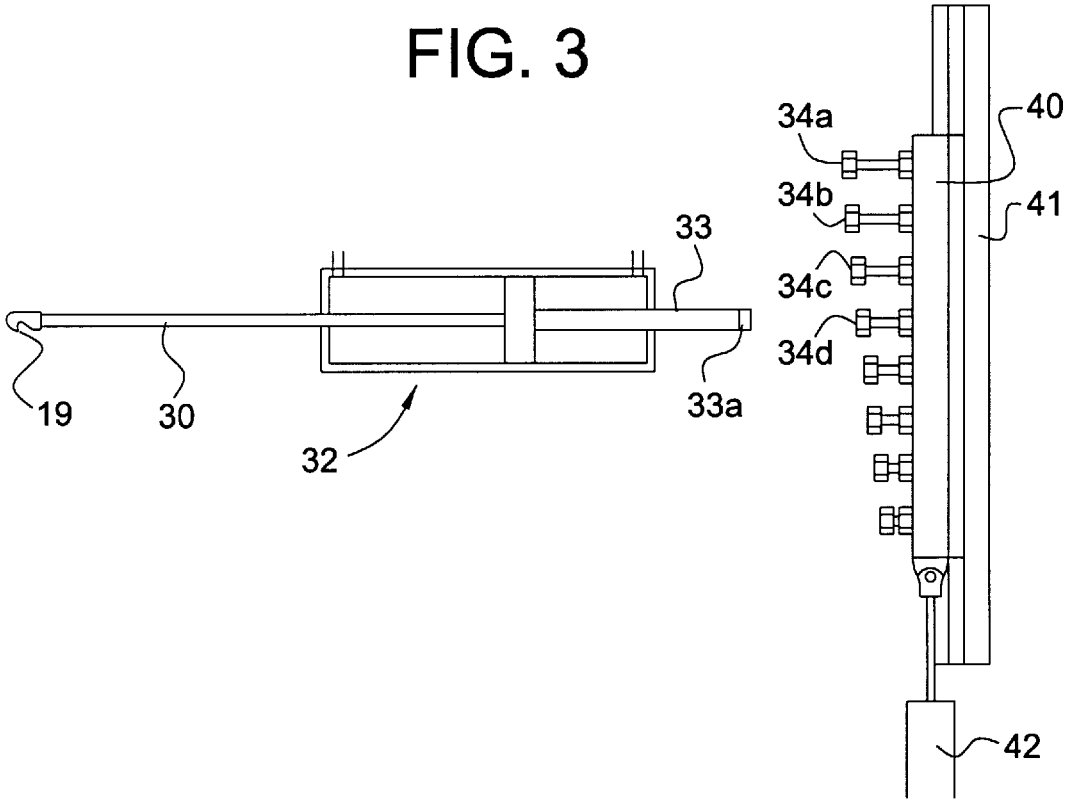
FIG. 3 is an overhead view of part of another embodiment of the mechanism on which the stops are mounted.

Stops 34*a*, 34*b*, 34*c*, 34*d* etc. (FIG. 3) may be secured to a slide 40 that can be advanced and retracted along a track 41 mounted on the framework, by a pneumatic piston-and-cylinder mechanism or solenoid 42, in increments corresponding to the pitch between the stops.

Figure 4:
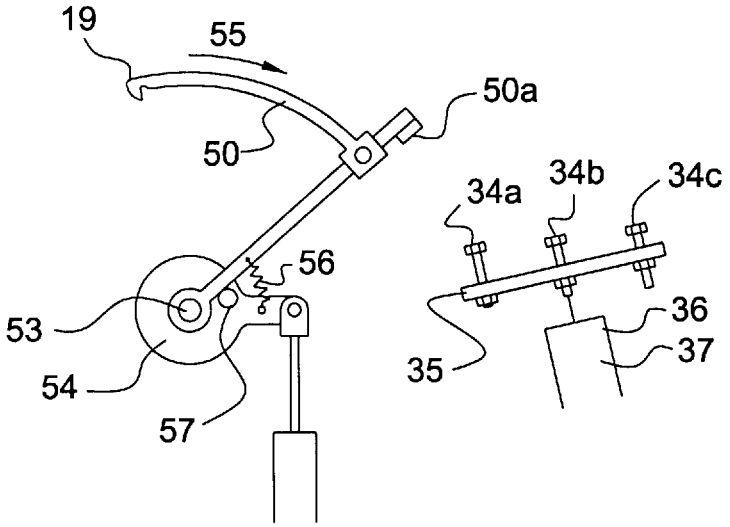
FIG. 4 is an overhead view of another embodiment of the device.

FIG. 4 illustrates how the device in accordance with the invention is employed with a particular mechanism comprising a hook 19 at the end of a curved rod 50 integral with an arm 52 extending radially out of a vertical shaft 53 attached to a driving device 54 that can pivot rod 50 back and forth along the arc of a circle. In this embodiment, the rotary attachment between vertical shaft 53 and an annular component of driving device 54 is not positive but by way of an interposed torque limiter, friction clutch, or other means or structure that will allow rotation of the annular component around vertical shaft 53 once a certain level of resistance has been overcome.

Thus, once driving device 54 has driven vertical shaft 53 in the direction indicated by arrow 55 and once the shank 50*a* on curved rod 50 has come to rest against one of the stops 34*a*, 34*b*, 34*c*, 34*d* etc. mounted on disk 35 or on any other such support, driving device 54 will be able to complete its motion without subjecting the mechanism to any damage. During the return stroke, an elastic device or spring 56 will maintain shank 50*a* against stop 34*a* as long as a stop 57 on the annular component of driving device 54 does not come into contact with arm 52.

Figure 5:
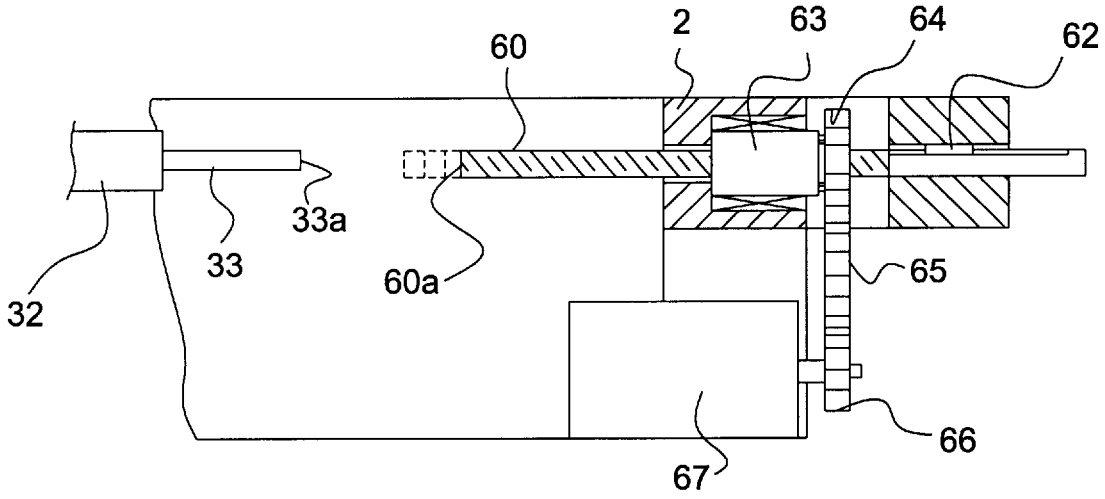
FIG. 5 is a partly sectional longitudinal view of another embodiment of the mechanism.

In FIG. 5, the stop that operates in conjunction with shank 33*a* or 50*a* comprises the free end 60*a* of a screw 60 that can slide back and forth but not turn in framework 2 subject to, for example, a pin 62. Screw 60 is accommodated in a ball nut 63 that can turn but not slide back and forth in framework 2 and is fastened to a notched pulley 64. Pulley 64 is connected to a notched pinion 66 by a notched belt 65. Pinion 66 is mounted tightly around the output shaft of a bidirectional stepped motor 67. Thus, turning on motor 67 rotates ball nut 63 one fraction of a turn and accordingly moves screw 60, varying the longitudinal position of the stop 60*a*.

Figure 6:
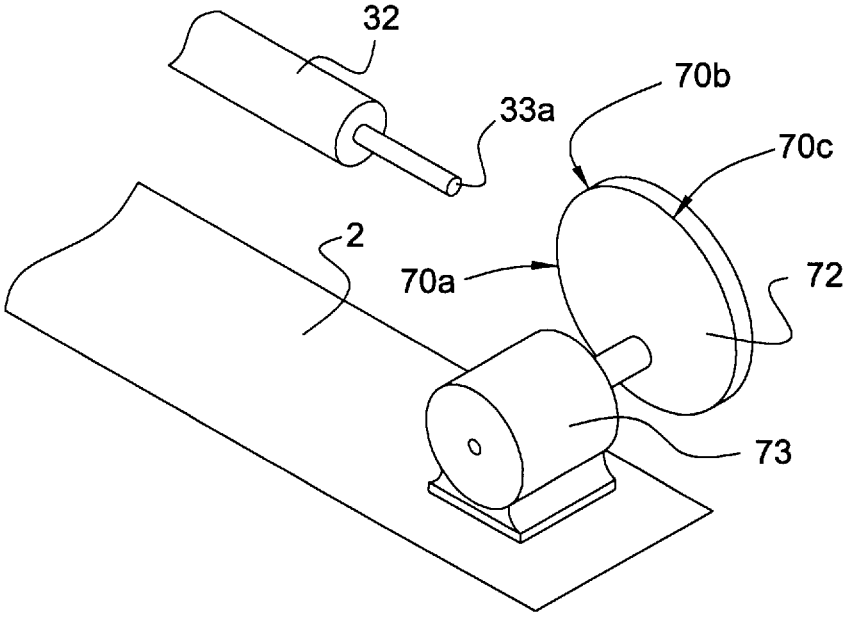
FIG. 6 is a perspective view of still another embodiment of the mechanism.

In the embodiment illustrated in FIG. 6, the mechanism whereon the surfaces of the stops are mounted comprises of a rotating cam 72 mounted tightly around the shaft of a motor 73 that rotates once per production cycle. The surfaces of stops 70*a*, 70*b*, 70*c*, etc. are represented by the various points along the periphery of cam 72.

It will be evident from the foregoing that the device in accordance with the present invention allows automatic production of undulating braided-head fringes, and the undulations can be of different forms.

The invention has been described with reference to preferred embodiments thereof, which are intended to be illustrative, not limiting. Various modifications can be made without departing from the spirit or scope of the invention as defined in the appended claims.

What is claimed is:

1. A frame for producing fringes with braided heads comprising:

a longitudinal framework having two spreads of warp thread;

a support perpendicular to the longitudinal framework, the support including a spool of core strand, a rotating wheel with at least one bobbin of twisted strand, and a device for forwarding the core and twisted stands parallel to a longitudinal direction of movement of the two spreads of warp thread;

a reciprocable driving device;

a hook connected to the reciprocable driving device that reciprocates to capture a selected twisted strand, the hook introducing the selected twisted strand between the two spreads of warp thread to produce a fringe, releasing the selected twisted strand and capturing another twisted strand; and a variable stop mechanism sequentially movable to vary a stroke of the hook in accordance with a desired pattern selected for the fringes.

2. The frame according to claim 1, wherein the reciprocable driving device further comprises:

a forward piston rod of a dual-action pneumatic piston-and-cylinder mechanism, the hook being positioned on the forward piston rod; and a shank associated with the rod and aligned to contact the variable stop mechanism, the shank being located on a rear piston rod of the dual-action mechanism.

3. The frame according to claim 1, further comprising a curved rod mounting the hook, the hook being connected by an arm radially extending from a shaft to the reciprocable device so as to reciprocally drive the hook along a circular path, the shaft and the reciprocable driving device being rotatably connected through an interposed clutch, and wherein the arm is biased using an elastic device against a stop on the reciprocable driving device.

4. The frame according to claim 1, wherein the variable stop mechanism includes a plurality of stops of different lengths mounted on a disk that rotates around an axis substantially parallel to a direction of movement of a rod, the disk being attached to a driving device that incrementally rotates the disk, and each of the stops projects from the disk towards a shank associated with the hook to a different length, the stops being distributed around the disk at intervals corresponding to one increment of rotation of the driving device.

5. The frame according to claim 1, wherein the variable stop mechanism includes a plurality of stops of different lengths mounted on a slide positionable along a track, and the stops are linearly distributed along the slide at intervals corresponding to increments of movement of a driving motor that drives the slide along the track.

6. The frame according to claim 1, wherein the variable stop mechanism comprises a screw that can slide back and forth in the framework, the screw operating in conjunction with a ball nut connected by a transmission to an output shaft of a bidirectional stepped motor.

7. The frame according to claim 1, wherein the variable stop mechanism comprises a rotating cam mounted around a shaft of a motor, the rotating cam being a surface that defines the desired fringe pattern.

8. A device for producing variable length fringes with braided heads, comprising:

means for forming a braided head including a core strand and at least one twisted strand;

means for intermeshing at least one warp thread with the core strand and the twisted strand;

means including a hook member for capturing the at least one twisted strand to create a fringe extending from the intermeshed core strand and twisted strand;

means for moving the hook member with the twisted thread along a selected path away from the braided head to a selected variable distance substantially equal to the length of the fringe; and means for stopping movement of the hook member when a shank associated with the hook member engages a surface of a variable stop mechanism.

9. A method for producing variable length fringes with braided heads, comprising:

forming a braided head including a core strand and at least one twisted strand;

intermeshing at least one warp thread with the core strand and the twisted strand;

capturing the at least one twisted strand with a hook member to create a fringe extending from the intermeshed core strand and twisted strand;

moving the hook member with the twisted strand along a selected path away from the braided head to a selected variable distance substantially equal to a length of the fringe; and stopping movement of the hook member when a shank member associated with the hook member engages a surface of a variable stop mechanism.

* * * * *